US007088357B2

(12) United States Patent
Kashiyama

(10) Patent No.: US 7,088,357 B2
(45) Date of Patent: Aug. 8, 2006

(54) POWER CIRCUIT FOR DISPLAY DRIVER, DISPLAY DEVICE, AND CAMERA

(75) Inventor: Ritsuo Kashiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/156,729

(22) Filed: Jun. 21, 2005

(65) Prior Publication Data

US 2005/0237290 A1 Oct. 27, 2005

Related U.S. Application Data

(62) Division of application No. 10/354,075, filed on Jan. 30, 2003.

(30) Foreign Application Priority Data

Feb. 6, 2002 (JP) ..... 2002-029390

(51) Int. Cl.
*G09G 5/00* (2006.01)

(52) U.S. Cl. ..... 345/212; 323/907

(58) Field of Classification Search ..... 345/211–213; 323/907

See application file for complete search history.

(56) References Cited

U.S. PATENT DOCUMENTS

| | | | | |
|---|---|---|---|---|
| 4,570,115 | A | 2/1986 | Misawa et al. | 323/313 |
| 5,113,210 | A | 5/1992 | Kashiyama et al. | 354/400 |
| 5,231,437 | A | 7/1993 | Kashiyama et al. | 354/152 |
| 5,402,042 | A | 3/1995 | Madsen | 315/174 |
| 5,444,597 | A | 8/1995 | Blake et al. | 361/234 |
| 5,469,026 | A | 11/1995 | Madsen | 315/169.4 |
| 5,675,352 | A | 10/1997 | Rich et al. | 345/89 |
| 6,160,591 | A * | 12/2000 | Stumfall et al. | 348/607 |

* cited by examiner

*Primary Examiner*—Ricardo Osorio
(74) *Attorney, Agent, or Firm*—Fitzpatrick, Cella, Harper & Scinto

(57) ABSTRACT

A power circuit supplies a plurality of voltages to a display-device-driving circuit for time-division-driving a display device. Each of the plurality of voltages are output via a constant-voltage circuit constituted by a regulator for dividing a voltage supplied from a power source and keeping the divided voltages at a certain voltage level, whereby a stable power source consuming a small amount of power when supplying power to a driving circuit as a power source for a display device to be time-division-driven can be obtained.

5 Claims, 6 Drawing Sheets

POWER CIRCUIT FOR DISPLAY DRIVER, DISPLAY DEVICE, AND CAMERA

This is a divisional application of application Ser. No. 10/354,075, filed Jan. 30, 2003, pending.

BACKGROUND OF THE INVENTION

1. Field of the Invention

The present invention relates to a power circuit for a display driver of a display device, particularly to a driving circuit of a liquid-crystal device. More particularly, the present invention relates to a display device for performing multiplex driving, and still more particularly relates to a power supplying circuit for driving a liquid-crystal device used for a liquid-crystal-driving circuit.

2. Related Background Art

FIGS. 8 and 9 show conventional liquid-crystal-driving-power supplying methods for multiplex driving a liquid-crystal device.

FIG. 8 is an illustration showing the resistance-dividing type power supplying method for driving a liquid crystal at a ⅓ bias. Reference numeral 101 denotes a battery serving as a power source, reference numeral 102 denotes a regulator connected to the battery 101 for keeping a voltage supplied from the battery 101 constant, and reference numerals 103, 104, and 105 denote resistors connected in series and having equal resistance values. One end of the resistor 103 is connected to the output of the regulator 102 and one end of the resistor 105 is connected to the negative side of the battery 101 and the ground side of the regulator 102 so as to divide an output voltage of the regulator 102. In this case, when assuming the output voltage of the regulator 102 as 4.5 V, a voltage of 3.0 V can be obtained at the connection point between the resistors 103 and 104 and a voltage of 1.5 V can be obtained at the connection point between the resistors 104 and 105.

Reference numeral 106 denotes an LCD driver (LCDDR) for driving an LCD, which receives a voltage from the battery 101 and an output of the regulator 102 and voltages divided by the resistors 103, 104, and 105 as LCD driving voltages.

Reference numeral 107 denotes a liquid-crystal panel connected to the LCD driver, which is turned on/off by the LCD driver 106.

FIG. 9 is an illustration showing a charge-pump type device for driving a liquid crystal at a ⅓ bias, in which reference numeral 108 denotes a battery serving as a power source, reference numeral 109 denotes a regulator connected to the battery 108 to keep a voltage supplied from the battery 108 constant, and reference numeral 110 denotes a charge-pump circuit for raising the voltage kept constant by the regulator 109. The charge-pump circuit outputs an input voltage, and the twofold-raised voltage and threefold-raised voltage of the input voltage. In this case, when assuming an output voltage of the regulator 109 as 1.5 V, 3.0 V is obtained as a twofold-raised voltage and 4.5 V is obtained as a threefold-raised voltage.

Reference numeral 111 denotes an LCD driver (LCDDR) for driving an LCD, which receives power from the battery 101 and a liquid-crystal-driving voltage from the charge pump 110. Reference numeral 112 denotes a liquid crystal panel connected to the LCD driver, which is turned on/off by the LCD driver 106.

However, since in the case of the use of the voltage divider using resistance shown in FIG. 8 in the above conventional examples, divided resistors are used to generate three types of voltages serving as LCD driver voltage sources, it is necessary to supply tens of microamperes or more to the current for the resistors of the voltage divider. Therefore, a mobile unit for always displaying data by using a battery as a power source has a problem that the service life of the battery is early completed because it consumes a large amount of power.

Moreover, the charge pump type device shown in FIG. 9 requires an oscillation circuit serving as a signal source for performing pumping-up and a capacitor for accumulating electric charges. Therefore, when the number of divided voltages for driving a liquid crystal increases, it is necessary to increase the number of capacitors by the increased number of divided voltages. Therefore, when the number of divided voltages to be raised increases, a problem occurs that the voltage ratio between the lowest voltage and the highest voltage increases and higher-side voltages do not become accurate integral multiples due to a switching loss and the like. Moreover, to supply stable power by using a charge-pump system, a circuit configuration becomes complex because it is necessary to stabilize power by using voltage stabilizer such as a series regulator and then boosting the power by a charge pump.

Furthermore, though some of the liquid-crystal drivers respectively having a built-in a charge pump circuit are marketed, most liquid-crystal drivers do not have a charge pump in general. Therefore, because charge-pump ICs for supplying LCD driver voltages are hardly marketed, it is actually difficult to constitute an LCD driver of a small current consumption by using a consumer IC.

SUMMARY OF THE INVENTION

To solve the above problems, the present invention makes it possible to provide a display driver of display devices consuming a small current without requiring a complex circuit such as a charge pump circuit by using a series regulator of a very small current consumption constituted by a plurality of CMOS circuits or the like and thereby obtaining the voltages for a multiplex driving mode from a voltage supplied from a power source such as a battery.

Moreover, when a voltage is equal to or lower than a power-source voltage, an output voltage of a series regulator is stable and it is possible to accurately raise a low voltage and a high voltage by integral multiples like in the case of a charge pump system even if the number of divided driving voltages increases.

The present invention relates to a power circuit for supplying a plurality of voltages to a driving circuit for multiplex driving mode, that is, a power circuit for a display driver in which the voltages are output via a constant-voltage circuit constituted by a regulator for dividing a voltage supplied from a power source and keeping the plurality of voltages at certain voltage levels.

Moreover, the present invention is characterized by a power circuit in which the above constant-voltage circuit is a step-down regulator.

Furthermore, the present invention is characterized by a power circuit in which the above constant-voltage circuit has means for correcting an output voltage in accordance with a temperature.

Furthermore, the present invention is characterized by a power circuit using one regulator IC in which a plurality of the above constant-voltage circuits are integrated.

Furthermore, the present invention is characterized by a power circuit in which each of the above constant-voltage circuits has at least two input terminals, one input terminal of each constant-voltage circuit is connected to the positive electrode of a power source, and the other input terminal of it is connected to the output of another constant-voltage circuit when connecting the constant-voltage circuits each other.

Furthermore, the present invention is characterized by a power circuit in which each of the constant-voltage circuits has at least two input terminals and includes a first constant-voltage circuit in which the above input terminals are connected to the positive and negative electrodes of the above power source and a second constant-voltage circuit in which the above input terminals are connected to the positive electrode of a power source and the output of the first constant-voltage circuit when connecting the constant-voltage circuits each other.

Furthermore, the present invention is characterized by a camera having a display device provided with a driving circuit using the above power circuit, and a data-copying function for copying the display data to the liquid-crystal device to a film.

DESCRIPTION OF THE PREFERRED EMBODIMENTS

The present invention is described below in detail in accordance with the illustrated embodiments.

Figure 1:
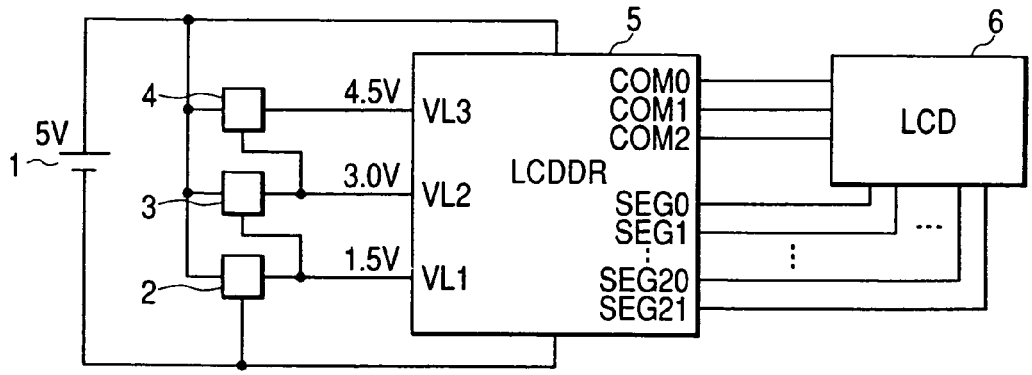
FIG. 1 is a block diagram of a liquid-crystal-driving circuit of the present invention.

FIG. 1 is a block diagram showing a configuration of a display driver of an embodiment of the present invention. In this case, a liquid-crystal device is used as a display device to show an example using a regulator constituted by a CMOS circuit consuming a small current. In FIG. 1, reference numeral 1 denotes a battery serving as a power source and reference numeral 2 denotes a regulator constituted by a CMOS circuit whose input is connected to the positive electrode of the battery 1 and whose VSS is connected to the negative electrode of the battery 1 to keep a voltage supplied from the battery 1 constant. Reference numeral 3 denotes a regulator constituted by a CMOS circuit whose input is connected to the positive electrode of the battery 1 and whose VSS is connected to the output of the regulator 2 to keep a voltage supplied from the battery 1 constant and reference numeral 4 denotes a regulator constituted by a CMOS circuit whose input is connected to the positive electrode of the battery 1 and whose VSS is connected to the output of the regulator 3 to keep a voltage supplied from the battery 1 constant.

In this case, the regulators 2, 3, and 4 are regulators having an equal output voltage. Because the VSS of the regulator 3 is connected to the output of the regulator 2, the output voltage of the regulator 3 becomes two times higher than the output voltage of the regulator 2 on the basis of the VSS of the regulator 2. Furthermore, because the VSS of the regulator 4 is connected to the output of the regulator 3, the output voltage of the regulator 4 is set to be three times higher than the output voltage of the regulator 2 on the basis of the VSS of the regulator 2.

Concrete voltage example is as follows. when assuming the voltage of the battery 1 as 5 V and the output voltage of each regulator as 1.5 V, the output voltage of the regulator 2 shows 1.5 V, that of the regulator 3 shows 3.0 V, and that of the regulator 4 shows 4.5 V.

Then, Reference numeral 5 denotes a liquid-crystal display driver (LCDDR) using the battery 1 as the power source of a circuit and the output of the regulator 2, 3, or 4 as the LCD driver voltages, in which the output of the regulator 2 is connected to VL1, that of the regulator 3 is connected to VL2 and that of the regulator 4 is connected to VL3. Reference numeral 6 denotes a liquid-crystal display device (liquid-crystal display panel) connected to the liquid-crystal display driver 5, which outputs multiplex signals to drive the liquid-crystal display panel 6 by applying common signals COM0, COM1, and COM2 and a segment signal of an SEG21 from an SEG0 through a common electrode and a segment electrode.

(Circuit Diagram of Regulator)

Figure 2:
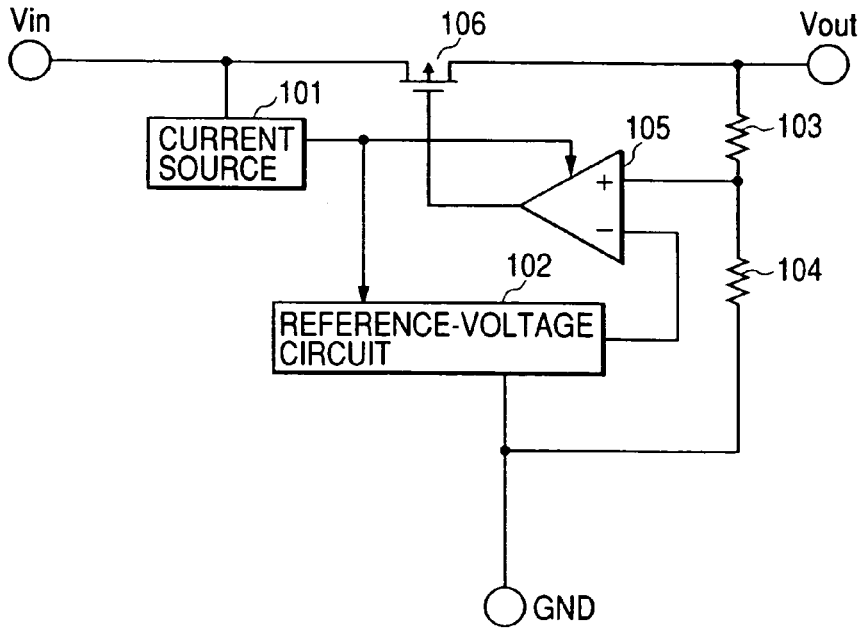
FIG. 2 is an internal circuit diagram of a regulator circuit of the present invention.

FIG. 2 is an illustration for explaining details of internal circuits of the regulators 2, 3, and 4, in which reference numeral 101 denotes a current source connected to the power input terminal of a regulator, reference numeral 102 denotes a reference-voltage circuit for generating a reference voltage in accordance with the current supplied from the current source 101, reference numeral 103 denotes a resistor whose one end is connected to the output terminal of a regulator, reference numeral 104 denotes a resistor whose one end is connected to the resistor 103 and whose other end is connected to GND, and reference numeral 105 denotes an operational amplifier whose negative input is connected to the output of the reference-voltage circuit 102 and whose positive input is connected to the resistors 103 and 104. Reference numeral 106 denotes an output-voltage control device serving as a P-channel MOSFET whose source is connected to the power input of a comparator, whose drain is connected to the output of a regulator, and whose gate is connected to the output of the operational amplifier 105. An input voltage is controlled to a specified output voltage by comparing a voltage obtained by dividing the output voltage of a regulator by the resistors 103 and 104 with the output voltage of the reference-voltage circuit by the operational amplifier 105 and controlling the gate voltage of the P-channel MOSFET in accordance with the output of the operational amplifier.

In this case, the regulator is constituted by a CMOS to control an output voltage by controlling the gate voltage of the P-channel MOSFET for controlling a voltage. Thereby, it is unnecessary to use the base current of a voltage control device like in the case of a bipolar transistor and it is possible to decrease the current of a power source. Therefore, it is possible to greatly reduce current consumption.

Figure 3:
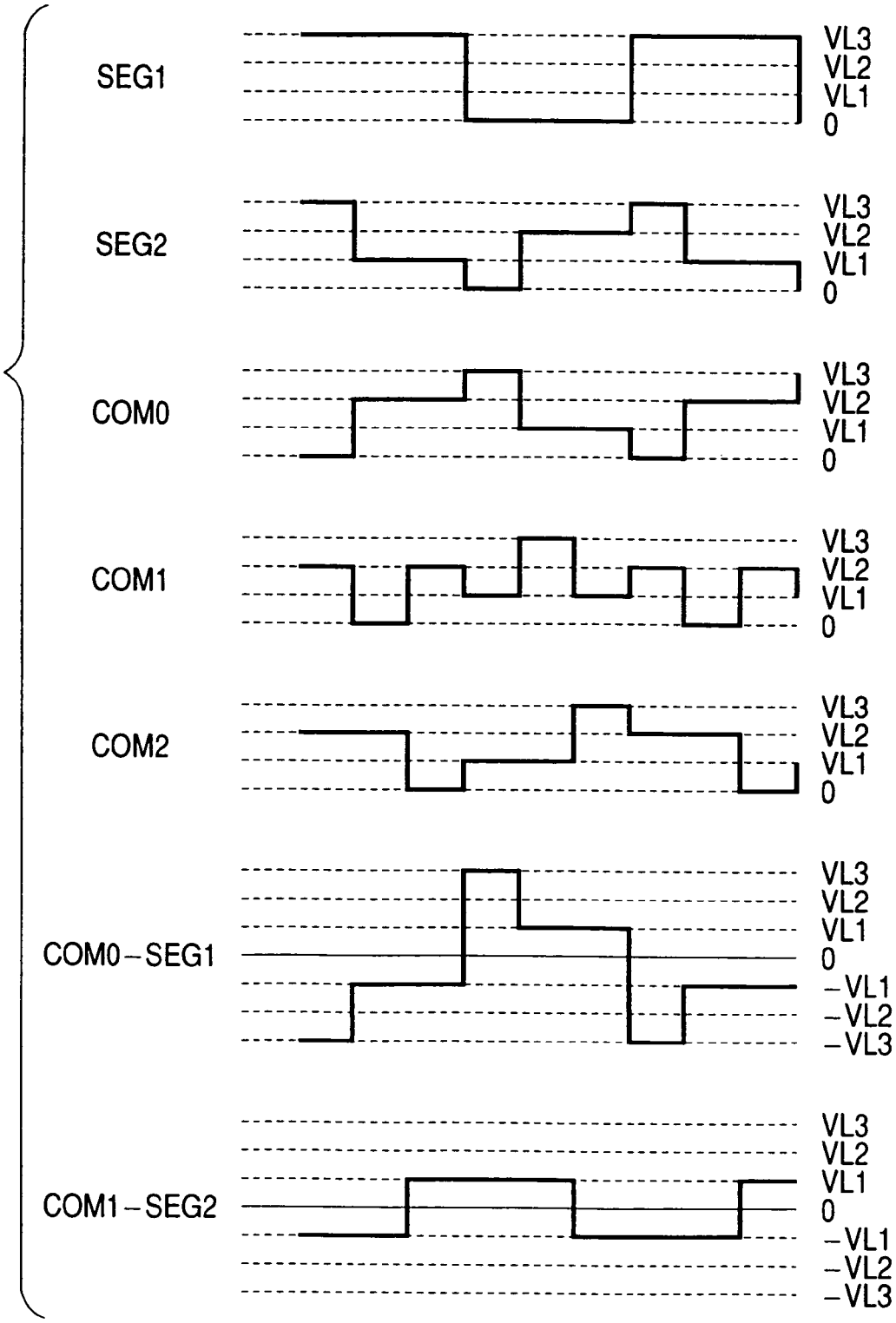
FIG. 3 shows graphs for explaining liquid-crystal-driving waveforms of the present invention.

FIG. 3 is an illustration showing driving voltages to be applied to common and segment electrodes when driving a liquid-crystal panel in accordance with the multiplex driving mode, showing signal waveforms applied from the liquid-crystal driver 5 to the liquid-crystal display device 6. A ⅓ bias system and a ⅓ duty system are described below as specific examples.

For each segment signal (SEG) and common signal (COM), voltages VL1, VL2, VL3, and 0 V generated by the regulators 2, 3, and 4 are output in accordance with a display state of a liquid crystal. In this case, the signal shown by "COM0–SEG1" in FIG. 3 as an ON voltage is applied to the liquid-crystal display portion connected with COM0 and SEG1 and the liquid-crystal display is turned on because the effective voltage of the ON voltage exceeds the turning-on voltage of the liquid crystal. Moreover, the signal shown by "COM1-SEG2" in FIG. 3 is applied to the liquid-crystal display portion connected with SEG2 and the liquid-crystal display portion is turned off because the effective voltage is lower than the turning-on voltage of the liquid crystal display.

(Explanation of Camera Using Liquid-Crystal Display Device)

Figure 4:
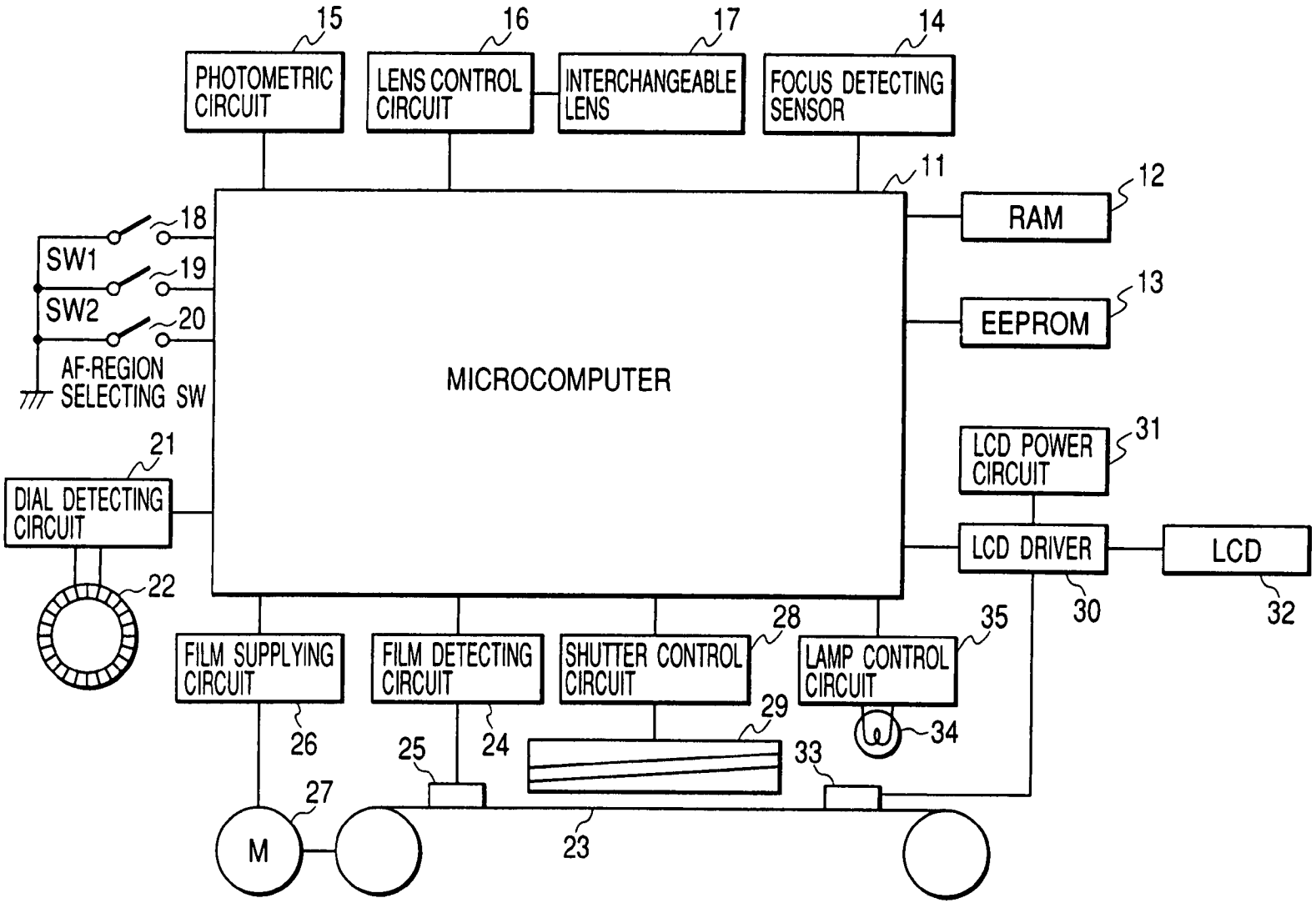
FIG. 4 is a block diagram of a camera using a liquid-crystal-driving circuit of the present invention.

FIG. 4 is a block diagram showing an electrical configuration of a camera to which the above LCD driver and liquid-crystal display device are applied. In FIG. 4, reference numeral 11 denotes a microcomputer for controlling the entire camera, reference numeral 12 denotes a RAM serving as memory means set to the outside of (or built in) the microcomputer 11, and reference numeral 13 denotes an EEPROM serving as nonvolatile memory means set to the outside of (or built in) the microcomputer 11. Reference numeral 14 denotes a focus detecting sensor connected to the microcomputer 11 to perform autofocusing, reference numeral 15 denotes a photometric circuit connected to the microcomputer 11 to measure the brightness of an object, and reference numeral 16 denotes a lens control circuit connected to the microcomputer 11 to control an electronic circuit in an interchangeable lens removable from a camera body. Reference numeral 17 denotes an interchangeable lens which is removable from a camera body and is connected to the lens control circuit 16 and includes an electronic circuit for controlling a lens in accordance with a control signal supplied from the lens control circuit 16.

Reference numeral 18 (SW1) denotes a switch connected to the microcomputer 11 to start photometry and focus detection and reference numeral 19 (SW2) denotes a switch connected to the microcomputer 11 to start exposure. Switches SW1 and SW2 are release switches respectively having a two-stage configuration. The switch SW1 is turned on in accordance with the first stroke of a release switch and switches SW1 and SW2 are both turned on in accordance with the second stroke of the release switch.

Reference numeral 20 denotes an AF (auto-focus)-region selecting switch connected to the microcomputer 11 to optionally select any one of a plurality of AF regions provided for the focus detecting sensor 14, reference numeral 21 denotes a dial detecting circuit connected to the microcomputer 11 to detect operations of dials for various settings provided for a camera, and reference numeral 22 denotes a setting dial connected to the dial detecting circuit 21 to perform various settings of a camera. It is possible to select an optional automatic AF region or an automatic AF-region selection in which a camera automatically selects an AF region by the AF-region selecting switch 20 and the dial.

Reference numeral 23 denotes a film loaded in a camera body (not illustrated), reference numeral 24 denotes a film detecting circuit controlled by the microcomputer 11 to detect the position of the film 23, reference numeral 25 denotes a photosensor driven by the film detecting circuit 24 to detect the position of the film 23, and reference numeral 26 denotes a film supplying circuit controlled by the microcomputer 11 to wind or rewind the film 23 by driving a film supplying motor 27. Reference numeral 28 denotes a shutter control circuit controlled by the microcomputer 11 to control a shutter for exposure, and reference numeral 29 denotes a shutter controlled by the shutter control circuit 28 to perform exposure.

Then, reference numeral 30 denotes a liquid-crystal display driver connected to the microcomputer 11 to display various information on an LCD, which corresponds to symbol 5 in FIG. 1. Reference numeral 31 denotes an LCD power circuit for supplying LCD driver voltages to the liquid-crystal display driver 30, which corresponds to the regulator 2, 3, or 4 in FIG. 1. Reference numeral 32 denotes an LCD panel connected to the liquid-crystal display driver 30 to display various setting states, operation states, or exposure information of a camera, which corresponds to the LCD 6 in FIG. 1. Reference numeral 33 denotes a copying LCD connected to the liquid-crystal display driver 30 to copy photographing data or user setting information to the film 23, which corresponds to the LCD 6 in FIG. 1. Reference numeral 34 denotes a lamp for copying the various information displayed on the LCD 33 to a film and reference numeral 35 denotes a lamp control circuit for turning on the lamp 34 and copying data.

Thus, a plurality of constant voltages are generated from a voltage supplied from a battery serving as a power source by using a plurality of regulators to turn on an LCD via a liquid-crystal display driver by using the certain voltages as LCD driver voltage sources.

Moreover, it is possible to obtain different liquid-crystal-driving voltages by using one type of a regulator and thereby connecting the output of one regulator with VSS of another regulator.

Though the LCD by multiplex driving mode has been described by a ⅓ bias and a ⅓ duty, it is also possible to use the above mode for other bias levels by changing the number of regulators.

Furthermore, it is possible to decrease the current consumption and always display data easily in the case of a unit using a battery as a power source such as a camera by using this LCD power circuit.

SECOND EMBODIMENT

Figure 5:
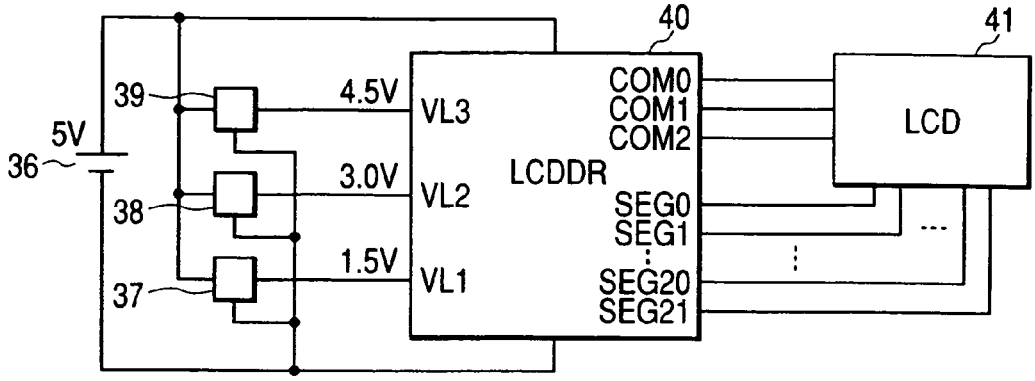
FIG. 5 is a block diagram of a liquid-crystal-driving circuit of another embodiment of the present invention.

FIG. 5 is a block diagram showing a second configuration of the display driver of second embodiment of the present invention. In FIG. 5, reference numeral 36 denotes a battery serving as a power source and reference numeral 37 denotes a regulator whose input is connected to the positive electrode of the battery 36 and whose VSS is connected to the negative electrode of the battery 36 to keep a voltage supplied from the battery 36 constant. In this case, the regulator outputs a voltage of 1.5 V. Reference numeral 38 denotes a regulator whose input is connected to the positive electrode of the battery 36 and whose VSS is connected to the negative electrode of the battery 36 to keep a voltage supplied from the battery 36 constant, which outputs 3.0 V which is a voltage two times higher than the output voltage of the regulator 37. Reference numeral 39 denotes a regulator whose input is connected to the positive electrode of the battery 36 and whose VSS is connected to the negative electrode of the battery 36 to keep a voltage supplied from the battery 36 constant, which outputs 4.5 V which is a voltage three times higher than the output voltage of the regulator 37. In this case, specific output voltages are set to 1.5 V, 3.0 V, and 4.5 V. However, by changing a voltage set in accordance with an LCD driving voltage, it is possible to drive LCDs having driving voltages different from each other.

Then, reference numeral 40 denotes a liquid-crystal display driver using the battery 36 as the power source of a circuit and outputs of the regulators 37, 38, and 39 LCD driver voltage sources. The output of the regulator 37 is connected to VL1, that of the regulator 38 is connected to VL2, and that of the regulator 39 is connected to VL3. Reference numeral 41 denotes a liquid-crystal display device connected to the liquid-crystal display driver 40, in which liquid crystal is driven in accordance with common signals COM0, COM1, and COM2 and segment signals of SEG0 to SEG21.

(Regulator for Outputting a Plurality of Voltages)

Figure 6:
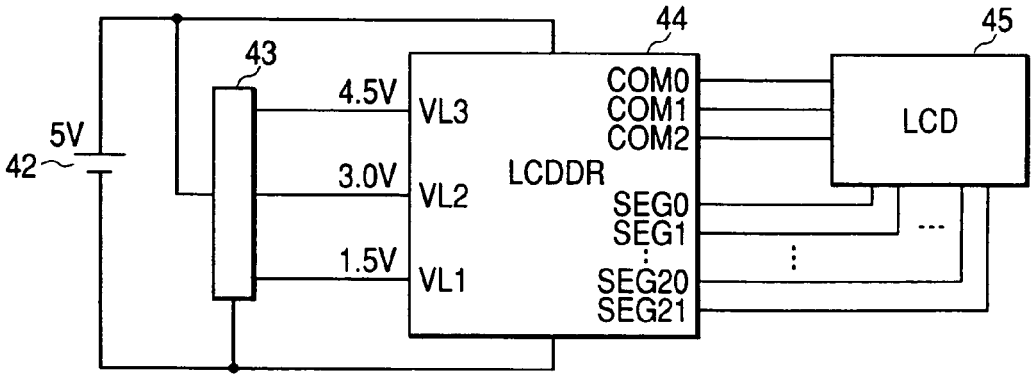
FIG. 6 is a block diagram of a liquid-crystal-driving circuit of further embodiment of the present invention.

FIG. 6 is a block diagram showing a third configuration of the LCD driver of an embodiment of the present invention using a regulator having a plurality of output terminals.

In FIG. 6, reference numeral 42 denotes a battery serving as a power source and 43 denotes a regulator whose input is connected to the positive electrode of the battery 42 and whose VSS is connected to the negative electrode of the battery 42 to keep a voltage supplied from the battery 36 as a plurality of constant voltages. In this case, the regulator 43 is constituted so as to output a plurality of voltages such as a first output of 1.5 V, second output of 3.0 V, and third output of 4.5 V.

Then, reference numeral 44 denotes a liquid-crystal display driver using the battery 42 as the power source of a circuit and a plurality of outputs of the regulator 43 as LCD driver voltage sources, in which a first output of the regulator 43 is connected to VL1, second output of it is connected to VL2, and third output of it is connected to VL3. Reference numeral 45 denotes a liquid-crystal display device connected to the liquid-crystal display driver 44, in which liquid crystal is driven in accordance with common signals COM0, COM1, and COM2 and segment signals of SEG0 to SEG21.

It is possible to decrease the size of a power-circuit portion by the above configuration.

(Description of One-Chip Configuration)

Figure 7:
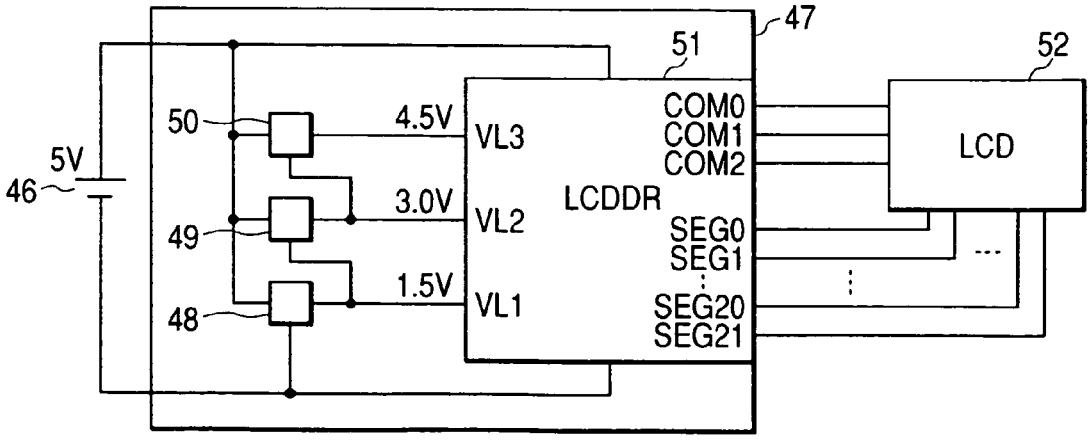
FIG. 7 is a block diagram of a liquid-crystal-driving circuit of still further embodiment of the present invention.
Figure 8:
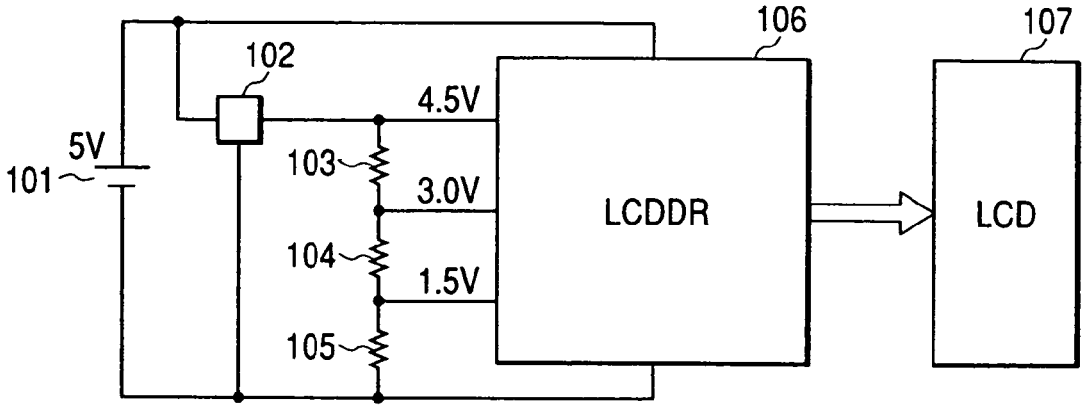
FIG. 8 PRIOR ART
FIG. 8 is a block diagram of a conventional liquid-crystal-driving circuit.
Figure 9:
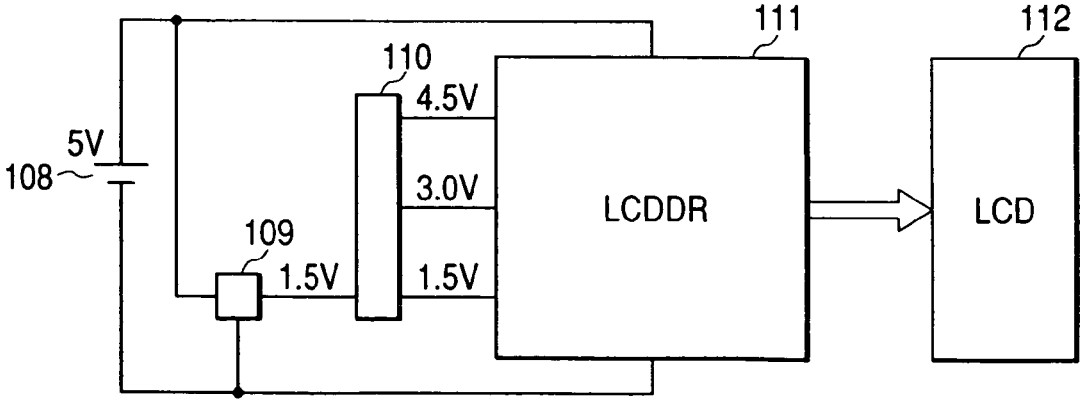
FIG. 9 PRIOR ART
FIG. 9 is a block diagram of a conventional liquid-crystal-driving circuit.

FIG. 7 is a block diagram showing a fourth configuration of a LCD driver of embodiment of the present invention constituted by integrating the above regulators and LCD driver.

In FIG. 7, reference numeral 46 denotes a battery serving as a power source and reference numeral 47 denotes an integrated circuit including an LCD driver function for driving a regulator for generating LCD driver voltage and a liquid-crystal display device. It is allowed to constitute the integrated circuit by one chip or multichip.

Reference numeral 48 denotes a regulator built in the integrated circuit 47 to keep a voltage supplied from a power source constant, which outputs a voltage of 1.5 V in this case. Reference numeral 49 denotes a regulator whose integrated-circuit input is connected to a power source and whose VSS is connected to the output of the regulator 48 to keep a voltage constant, which outputs 3.0 V two times higher than the output voltage of the regulator 48. Reference numeral 50 denotes a regulator whose input is connected to a power source and whose VSS is connected to the output of the regulator 49 to keep a voltage constant, which outputs 4.5 V three times higher than the output voltage of the regulator 48. In this case, specific output voltages are set to 1.5 V, 3.0 V, and 4.5 V. However, it is possible to drive LCDs having driving voltages different from each other by changing a voltage in accordance with the driving voltage of an LCD. Reference numeral 51 denotes a liquid-crystal display driver built in the integrated circuit 47 to use outputs of the regulators 48, 49, and 50 as LCD driver voltage sources, in which the output of the regulator 48 is connected to VL1, that of the regulator 49 is connected to VL2, and that of the regulator 50 is connected to VL3. The liquid-crystal display device 51 connected to the liquid-crystal display driver 50, is driven in accordance with common signals COM0, COM1, and COM2 and segment signals of SEG0 to SEG21.

Thus, a plurality of constant voltages are generated from a voltage supplied from a battery serving as a power source by using a plurality of regulators so as to turn on an LCD via a liquid-crystal display driver by using the certain voltages as LCD driver voltage sources.

Moreover, a plurality of constant voltages are generated from a voltage supplied from a battery serving as a power source by using a regulator having a plurality of output terminals so as to turn on an LCD via a liquid-crystal display driver by using the constant voltages as LCD driver voltage sources.

Figure 10:
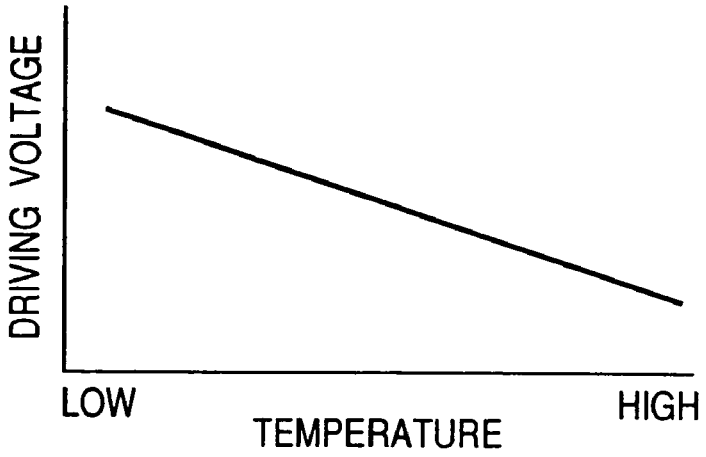
FIG. 10 is a graph showing a temperature characteristic of a driving voltage.

Furthermore, as shown in FIG. 10, because an optimum driving voltage depends on a change of environmental temperatures, it is necessary to perform temperature compensation for a driving voltage in order to perform driving so that a stable contrast can be obtained under a broad temperature environment.

Figure 11:
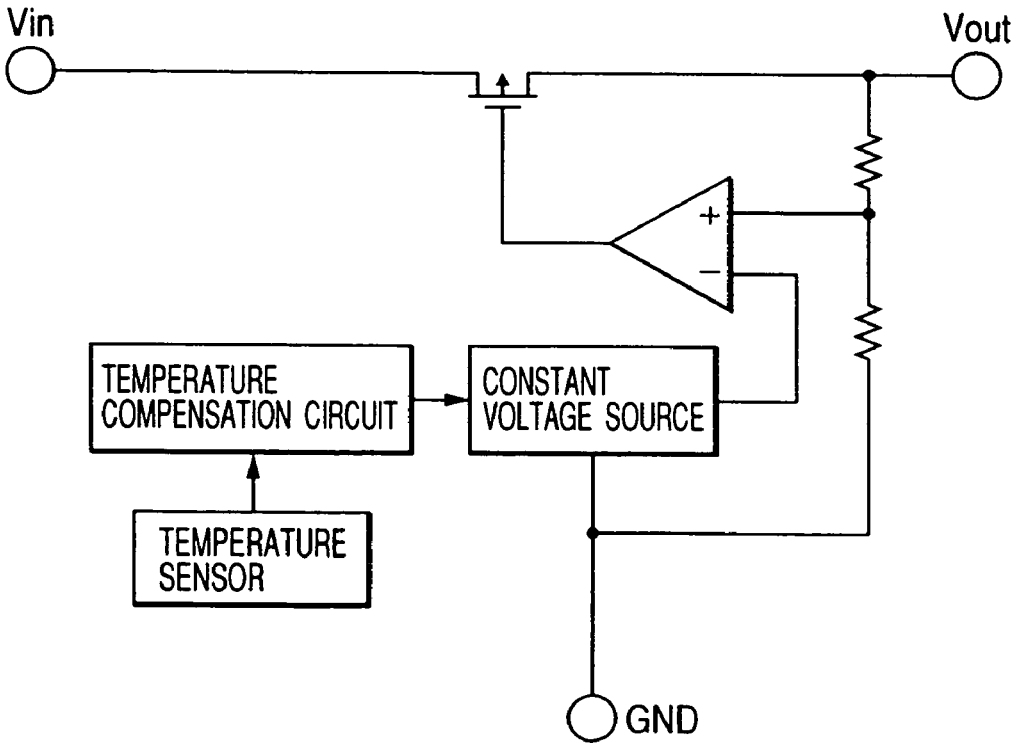
FIG. 11 is a circuit diagram of a regulator having a temperature sensor.

Therefore, as shown in FIG. 11, it is also possible to apply an optimum voltage to a liquid-crystal panel by providing a temperature sensor function for the inside of a regulator and thereby performing temperature compensation for a voltage output from the regulator along a driving voltage of the LCD. To realize the above mentioned, it is effective to use a method of changing power-source voltages in accordance with an output from a temperature sensor by setting the relation between temperature and output voltage in a temperature compensation circuit in the form of a reference table.

Moreover, a configuration using a CMOS circuit of a small current consumption is generally used as the structure of a regulator used for the present invention. However, when the current consumption is small, it is allowed to use another type such as a bipolar type as long as it consumes a small current.

As described above, a method is provided which obtains a power source for multiplex driving a display device such as a liquid-crystal display device from a voltage supplied from a power source such as a battery by using a regulator consuming a very small current constituted by a plurality of CMOS circuits. Thereby, it is possible to provide an LCD driver of a small current consumption without using a complex circuit such as a charge pump circuit.

Moreover, because of a simple configuration using only a series regulator and a general-purpose liquid-crystal display driver, it is possible to always display data on a liquid-crystal display portion by a simple circuit configuration without considering the service life of a battery also in the case of a unit using a battery as a power source such as a camera. Though the present invention is described on a liquid-crystal display device, it is also effective for another display device according to a different display principle such as an organic electroluminescence device or an electrophoresis display device.

What is claimed is:

1. A display apparatus comprising:

a display device;

a driving circuit configured to drive the display device by a multiplex driving waveform, the multiplex driving waveform being constructed from a plurality of voltage levels; and a power circuit configured to supply the plurality of voltages to the driving circuit, wherein the power circuit comprises a plurality of constant-voltage circuits, each of which has two input terminals and an output terminal connected to an input terminal of another constant-voltage circuit.

2. The display apparatus according to claim 1, wherein the plurality of constant-voltage circuits comprise a step-down regulator.

3. The display apparatus according to claim 1, wherein the plurality of constant-voltage circuits have means for correcting an output voltage in accordance with a temperature.

4. The display apparatus according to claim 1, further comprising one regulator integrated circuit in which the plurality of constant-voltage circuits are integrated.

5. The display apparatus according to claim 1, wherein the display device is a liquid-crystal device.

* * * * *

UNITED STATES PATENT AND TRADEMARK OFFICE

CERTIFICATE OF CORRECTION

PATENT NO. : 7,088,357 B2
APPLICATION NO. : 11/156729
DATED : August 8, 2006
INVENTOR(S) : Ritsuo Kashiyama It is certified that error appears in the above-identified patent and that said Letters Patent is hereby corrected as shown below:

ON THE TITLE PAGE, AT ITEM (57), Abstract:
Line 3, “are” should read --is--.

COLUMN 3:
Line 4, “circuits” should read --circuits to--.
Line 15, “circuits” should read --circuits to--.

Signed and Sealed this

Sixth Day of January, 2009

JON W. DUDAS
*Director of the United States Patent and Trademark Office*